US010821767B1

(12) United States Patent
Hawthorne

(10) Patent No.: US 10,821,767 B1
(45) Date of Patent: Nov. 3, 2020

(54) BINDER WITH EXPANDABLE SPINE

(71) Applicant: Lo-Res Labs LLC, Mill Valley, CA (US)

(72) Inventor: Grace Hawthorne, Mill Valley, CA (US)

(73) Assignee: Lo-Res Labs LLC, Mill Valley, CA (US)

( * ) Notice: Subject to any disclaimer, the term of this patent is extended or adjusted under 35 U.S.C. 154(b) by 0 days.

(21) Appl. No.: 16/667,460

(22) Filed: Oct. 29, 2019

(51) Int. Cl.
*B42F 13/38* (2006.01)
*B42F 13/22* (2006.01)

(52) U.S. Cl.
CPC ..... *B42F 13/38* (2013.01); *B42F 13/22* (2013.01)

(58) Field of Classification Search
CPC ..... B42F 13/38; B42F 13/22
USPC ..... 402/4, 8, 19, 20, 24, 60, 70, 73, 74, 75, 402/76
See application file for complete search history.

(56) References Cited

U.S. PATENT DOCUMENTS

| | | | | |
|---|---|---|---|---|
| 659,860 | A | | 10/1900 | Schild |
| 908,596 | A | | 1/1909 | Morden |
| 957,459 | A | | 5/1910 | Duesler |
| 991,753 | A | | 5/1911 | Schober |
| 1,163,766 | A | | 12/1915 | Morden |
| 2,289,949 | A | | 7/1942 | Wisdom |
| 2,715,906 | A | | 8/1955 | Lucchesi |
| 3,572,957 | A | | 3/1971 | Strassberg |
| 3,933,294 | A | | 1/1976 | Meenan et al. |
| 4,284,227 | A | | 8/1981 | Corey |
| 4,630,843 | A | * | 12/1986 | Willat ..... B42F 13/0013 156/292 |
| 4,848,797 | A | | 7/1989 | Vercillo et al. |
| 5,213,368 | A | | 5/1993 | Wyant |
| 5,213,370 | A | * | 5/1993 | Hood ..... B42D 1/08 281/29 |
| 5,222,825 | A | | 6/1993 | Wyant |
| D344,540 | S | | 2/1994 | Wyant |
| 5,575,505 | A | | 11/1996 | Bridges |
| 5,607,246 | A | | 3/1997 | Podosek |
| 5,620,207 | A | | 4/1997 | Podosek et al. |
| 5,720,564 | A | * | 2/1998 | Winzen ..... B42F 13/0053 281/29 |
| 5,893,585 | A | | 4/1999 | Worthen |
| 6,010,157 | A | | 1/2000 | Pierson et al. |
| 6,076,990 | A | | 6/2000 | Jahn |
| 6,168,337 | B1 | | 1/2001 | Adams |
| 6,234,701 | B1 | | 5/2001 | Karten et al. |
| 6,364,559 | B2 | | 4/2002 | Brown et al. |
| 6,435,753 | B1 | | 8/2002 | Gusack |

(Continued)

FOREIGN PATENT DOCUMENTS

| | | |
|---|---|---|
| EP | 0334260 A2 | 9/1989 |
| WO | 00/54989 A1 | 9/2000 |

*Primary Examiner* — Justin V Lewis
(74) *Attorney, Agent, or Firm* — Young Basile Hanlon & MacFarlane, P.C.

(57) ABSTRACT

A binder comprising: (a) a front cover; (b) a rear cover; (c) a spine extending between and connecting the front cover and the rear cover, the spine being made of a different material than the front cover and the rear cover; and (d) a binder mechanism; wherein the spine is a reinforced polymer that is sufficiently flexible to allow the front cover, the rear cover, or both to move relative to the spine so that the front cover, the rear cover, or both are openable and closeable.

16 Claims, 13 Drawing Sheets

(56) References Cited

U.S. PATENT DOCUMENTS

| | | | | |
|---|---|---|---|---|
| 6,644,882 | B2 | 11/2003 | Brown et al. | |
| 7,063,477 | B2 | 6/2006 | Busam et al. | |
| 7,347,640 | B2 | 3/2008 | Chizmar | |
| 8,277,140 | B2 | 10/2012 | Chizmar | |
| D811,476 | S | 2/2018 | Lusk | |
| 2004/0164543 | A1 | 8/2004 | Yamamoto et al. | |
| 2005/0036825 | A1 | 2/2005 | Pangburn | |
| 2005/0058502 | A1 | 3/2005 | Ben-Or | |
| 2012/0087714 | A1* | 4/2012 | Chang | B42F 13/0013 402/73 |
| 2013/0189055 | A1* | 7/2013 | Bloomberg | B42B 5/06 412/6 |
| 2016/0059613 | A1* | 3/2016 | Patel | B42F 13/26 402/70 |

* cited by examiner

BINDER WITH EXPANDABLE SPINE

FIELD

The present teachings relate to a binder with a flexible spine that accommodates multiple pages, protects the materials within the binder, while the binder expands to accommodate the multiple pages.

BACKGROUND

Typically, notebooks and binders include covers and a spine. The spine allows the covers to move. The binders also include a binder mechanism that allows for materials to be added and removed. These binders typically have a solid shape that receives a predetermined amount of materials and the binders take up a predetermined amount of space.

Examples of binders are disclosed in U.S. Pat. Nos. 908,596; 1,163,766; 2,289,949; 4,284,227; 5,575,505; 6,010,157; and 6,644,882 all of which are expressly incorporated herein by reference for all purposes. Thus, there is a need for an expandable binder that compresses when not full to reduce in thickness and is expandable to even expand beyond the capacity of the binder mechanism to accommodate multiple sheets of paper or additional items stored in the interior of the binder. What is needed is a binder that expands to accommodate sheets of paper without the covers retracting to expose edges of the paper. It would be desirable to have a binder that is free of hinges that allow the binder to move. What is needed is a binder that is sufficiently strong to retain a binder mechanism and is flexible to expand and contract as items are added or removed.

SUMMARY

The present teachings provide: a binder comprising: (a) a front cover; (b) a rear cover; (c) a spine extending between and connecting the front cover and the rear cover, the spine being made of a different material than the front cover and the rear cover; and (d) a binder mechanism; wherein the spine is a reinforced polymer that is sufficiently flexible to allow the front cover, the rear cover, or both to move relative to the spine so that the front cover, the rear cover, or both are openable and closeable.

The present teachings provide: a method comprising: (a) connecting a material of a spine to a material of a front cover; (b) connecting the material of the spine to a material of a rear cover; (c) connecting a binder mechanism to the material of the spine; (d) creating one or more expansion regions within the spine; wherein the material of the spine and the material of the front cover and the material of the rear cover are different materials; and wherein the spine is a reinforced material that is sufficiently flexible to allow the front cover, the rear cover, or both to move relative to the spine so that the front cover, the rear cover, or both are openable and closeable.

The present teachings provide an expandable binder that compresses when not full to reduce in thickness and is expandable to even expand beyond the capacity of the binder mechanism to accommodate multiple sheets of paper or additional items stored in the interior of the binder. The present teachings provide a binder that expands to accommodate sheets of paper without the covers retracting to expose edges of the paper. The present teachings provide a binder that is free of hinges that allow the binder to move. The present teachings provide a binder that sufficiently strong to retain a binder mechanism and is flexible to expand and contract as items are added or removed.

DETAILED DESCRIPTION

Figure 1:
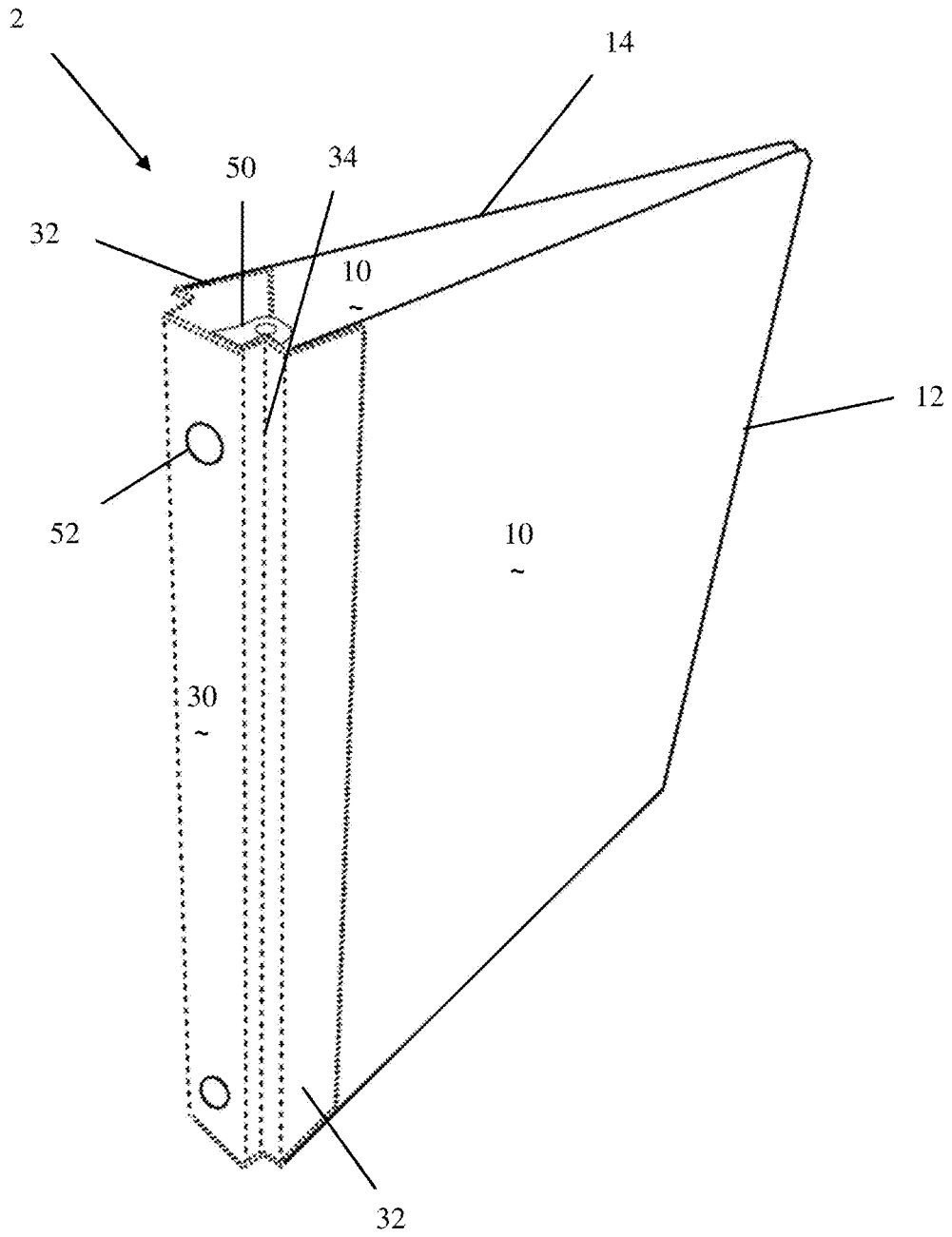
FIG. 1 is a perspective view of a binder.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings are predicated upon providing a binder that holds and protects materials such as paper. The binder functions to connect papers therein and prevent damage to the papers or other materials stored within the binder. The binder may store and protect any item or items that may fit within the binder. For example, the binder could store paint samples, carpet samples, plastic materials, photographs, cards, cards within plastic, notebooks, pens, pencils, markers, crayons, rulers, school supplies, books, or a combination thereof. The binder may include pockets, a binder mechanism, or both. The binder may connect the papers within the binder. The binder may include covers, a spine, a binder mechanism, or a combination thereof.

The covers function by extending over the papers and preventing damage to the papers. The covers may extend over sides over the paper. The cover may be rigid. The cover may be flexible. The front cover, the rear cover, or both may be flexible. The cover may be fluid resistant. The cover may be tear resistant, puncture resistant, or both. The cover may resist coloring, writing, marking, or a combination thereof.

The cover may be decorated. The cover may be decorated by crayons, markers, pencils, pens, stickers, paint, or a combination thereof. The cover may be made of a single material. The cover may be made of multiple materials. The cover may include a rigidification device that is covered by a protector. The cover may include only a rigidification device. The cover may include only a protector. The cover may include a front cover and a rear cover. The front cover and the rear cover may be identical. The front cover and the rear cover may be different. Dimensions of the front cover and the rear cover may be identical. The front cover may be made of a material that may be decorated. The rear cover may be made of a material that may be decorated. The rear cover may be made of a material that may prevent decoration. The front cover and the rear cover may extend generally parallel from a spine in the filled position, the empty position, or a position therebetween. The front cover and the rear cover may extend a distance from the spine and the distance may be the same regardless of whether the binder is full or empty. For example, the spine may expand and contract and the front cover and the rear cover may just move towards or away from each other. The front cover, the rear cover, or both may include rigidification devices, protectors, sealed regions, connection regions, or a combination thereof.

The rigidification devices function to make all or a portion of a front cover, rear cover, or both rigid. The rigidification devices function to protect the contents of the binder. The rigidification devices may be an internal component of a cover. The rigidification devices may be exposed (e.g., not covered). The rigidification devices may sandwich a connection region. The rigidification device may be directly connected to a connection region of a spine. The rigidification device may be made of a material that is rigid, prevents bending, protects contents of the binder, resists fluids, is customizable, or a combination thereof. The rigidification devices may be made of cardboard, wood, oriented strand board, plastic, a polymer, paper, or a combination thereof. The rigidification devices may be covered, uncovered, protected, customizable, or a combination thereof. The rigidification devices may be permanently or temporarily colored or decorated. The rigidification devices may receive pen, pencil, ink, marker, paint, dye, dry erase markers, stickers, or a combination thereof. The rigidification devices may be covered by a protector.

The protector may function to repel fluids, dirt, protect a rigidification device, or a combination thereof. The cover may be made only of a protector. The cover may be made of a combination of protectors and rigidification features. The protectors may connect to the spine via connection regions. The connection regions may directly connect to the protect. The connection regions may indirectly connect to the protector (e.g., the connection regions may connect to a rigidification feature and the protector may connect to the rigidification features). The protector may be made of or include plastic, a polymer, metal, leather, vinyl, polyvinyl chloride (PVC), or a combination thereof. The protector may be opaque. The protector may be transparent. The protector may extend along one or more sides of rigidification device. The protector may extend only along sides (e.g., major side of the cover). The protector may be one continuous piece of material. The protector may extend along a side and wrap to an edge or around an edge (e.g., a thickness of the rigidification device, cover, or both). A protector may extend along an outside, an inside, or both of a cover. The protectors may substantially encapsulate, encapsulate, or both the front cover, the rear cover, a connection region between the spine and the front cover, a connection region between the spine and the rear cover, or a combination thereof. Each cover may include two opposing protectors. Two opposing protectors may connect together at a sealed region.

The sealed region may be where protectors connect together. The sealed region may be where a single sheet folds upon itself and the sheet connects together. The sealed region may be two or more separate sheets that connect together. The sealed region may be formed by melting, gluing, mechanically fastening, chemically fastening, heating, or a combination thereof. The sealed region may form a periphery around a cover, a rigidification device, or both. The sealed region may substantially encapsulate or encapsulate a cover, a rigidification feature, or both. The sealed regions may create a peripheral edge. The sealed regions may extend around one edge, two edges, three edges, or four edges. The sealed regions may extend around three edges and terminate proximate to the connection regions, the spine, or both. The sealed regions may extend around the spine or incorporate the spine. The sealed regions may form a connection between the cover and the spine.

The spine may function to connect the front cover and the rear cover. The spine may connect a binder mechanism within the binder. The spine may be flexible. The spine may be expandable, contractable, or both. The spine may be made of a flexible material. The spine may be free of hinges. The spine may be made of one continuous piece of material. The spine may include one or more rigidification devices. A rigidification device may extend proximate to the binder mechanism, behind the binder mechanism, or both. All or a portion of the spine may be flexible. A portion of the spine may be rigid, and a portion of the spine may be flexible. The portion proximate to the binder mechanism may be rigid and the portion along one or both sides of the binder mechanism may be flexible. The spine may be flexible enough to expand beyond a capacity of the binder mechanism. The spine may be sufficiently flexible to allow the front cover to move relative to the rear cover. The spine may be sufficiently flexible to allow the front cover, the rear cover, or both to move relative to internal components of the binder. The spine may be made of a polymer. The spine may be made of a reinforced polymer. The spine may include fibers. The spine may be made of fibers. The spine may be made of or include polyethylene, polypropylene, nylon, a polyamide, acrylonitrile butadiene styrene (abs), low-density polyethylene (LDPE), high-density polyethylene (HDPE), polyvinyl chloride (PVC), polystyrene (PS), rubber, a natural rubber, a synthetic rubber, silicone, cloth, a tape, a nylon tape, a cloth tape, or a combination thereof. The compositions may contain fillers or reinforcing fibers. The composition may include an adhesive on one or both sides and be formed as a tape or adhesive may be added to form a connection. Exemplary fillers include inorganic fillers, for example, talc, mica, kaolin, diatomaceous earth, calcium carbonate, calcium sulfate, barium sulfate, and potassium titanate.

Reinforcing fibers are used to enhance the properties of substrates prepared from the compositions. Any reinforcing fibers that improve the properties of substrates made utilizing the fibers may be used in the compositions. Fibers may be utilized to improve one or more of the following properties: impact resistance, as demonstrated by notched Izod; modulus, as demonstrated by tensile modulus and flex modulus; tensile strength; improved creep resistance as determined by test method ASTM D2990 and the like. Exemplary fibers include glass fibers, carbon fibers, metal based fibers, polymeric fibers, and the like. Exemplary metal based fibers include stainless steel, and the like. Exemplary polymeric fibers include polyamide fibers, cellulose ether fibers, polyolefin fibers and the like. This disclosure contemplates the use of a mixture of types of fibers, for instance glass and stainless steel fibers or glass fibers and carbon fibers. Preferred classes of fibers are glass and polymeric fibers. Even more preferred are glass fibers. Fillers and/or reinforcing fibers may be present in an amount equal to or greater than about 0.5 percent by weight, equal to or greater than about 1 part by weight, equal to or greater than about 2 percent by weight, equal to or greater than about 5 percent by weight, or equal to or greater than about 10 percent by weight based on the weight of the composition. The fillers and/or reinforcing fibers may be present in an amount equal to or less than about 60 percent by weight, equal to or less than about 40 percent by weight, equal to or less than about 30 percent by weight, equal to or less than about 25 percent by weight, or equal to or less than about 20 percent by weight based on the weight of the composition. The spine may be made by selecting one or more of the materials listed herein and creating a film. The spine may be made of a material discussed herein formed into fibers and then the fibers compressed together. The spine may be made of a material that is tear resistant. The fibers of the material or fibers located within material of the spine may be randomly oriented (e.g., 20 percent or less of the fibers face in a same direction or preferably 10 percent or less of the fibers face in a same direction). The spine may be made of a material that is impregnated with fibers. The spine may be one or more sheets, two or more sheets, three or more sheets that are connected together. The spine may have sheets that are connected together via a mechanical fastener, a chemical faster, or both. The spine may be sheets that are glued together, melted together, heat staked, stapled, sewn, or a combination thereof. The spine may be free of hinges. The spine may be free of mechanical hinges. The spine may be made of a different material than the cover, the protector (e.g., a first material), the rigidification device (e.g., a second material), or a combination thereof (e.g., a third material). The spine may be movable due to flexibility of the spine material. The spine may include one or more expansion regions, one or more connection regions, or both.

The one or more connection regions may function to connect the spine to other components of the binder. Preferably, the one or more connection regions connect the spine to the cover. More preferably, a first connection region connects a spine on a first edge to a first cover and a second connection region connects a spine on a second edge to a second cover. The connection region may be an overlap between the spine and the covers. The connection region may be a region where the spine and cover connect (e.g., protector, rigidification feature, or both). The connection region may be connected via a mechanical fastener, a chemical fastener, or both. The connection region may be connected with an adhesive, sewing, stapling, melting, gluing, heat staking, encapsulating, or a combination thereof. The connection regions may extend along a first side, a second side, or both of the cover. The connection regions may be located between two or more layers of the cover. The connection regions may be located proximate to an expansion region.

The expansion region may function to allow the spine to expand to accommodate more papers or materials. The expansion region may expand without the cover being retracted. For example, an end of the cover may be located a distance away from the spine and the distance may be the same when the binder is full and the binder is empty. The expansion regions may expand the spine beyond a capacity of the binder mechanism. The expansion regions may accommodate additional materials within the binder in addition to the materials located within the binder mechanism. For example, an extra notebook may be added above the materials within the binder mechanism and the expansion regions may expand the cover to accommodate the notebook. The expansion regions may expand without lateral movement of ends of the front cover and the rear cover towards the spine. The covers in the filled position may move away from each other to accommodate more papers or materials. The covers in the empty position may move towards each other. The expansion regions may fold together when in an empty position to reduce a thickness of the binder. The expansion regions may unfold to increase thickness of the binder. The expansion regions may be one or more, two or more, or three or more folds that accordion together. The expansion region may be a pleat. The expansion regions may be located on one or both sides of a binder mechanism. The expansion regions may be located proximate to a first cover, a second cover, or both. The expansion regions may flex. The expansion regions may be made entirely of the material of the spine. The expansion regions may be movable between a filled position and an empty position. The expansion regions may be excess material. The expansion region may be material that folds upon itself in an empty position and unfolds in a filled position.

The binder mechanism may function to receive materials, hold materials, or both within the binder. The binder mechanism may connect directly to the spine. The binder mechanism may be static relative to all or a portion of the spine. The expansion regions, the connection regions, or both of the spine may be movable relative to the binder. The binder mechanism may provide support to the spine, the binder, or both. The binder mechanism may include one or more fasteners that extend through the spine to form a connection.

The fasteners may function to form a connection between the binder mechanism and the spine. The fasteners may connect to one or more layers of a spine. The fasteners may be located entirely on an inside of the spine. The fasteners may extend from a first side of the spine to a second side of the spine. The fasteners may be a rivet, nail, screw, set screw, binding post and screw, glue, sewing, staples, or a combination thereof. The fasteners may extend from an external location of a spine and into a threaded portion of a binder mechanism. The fasteners may be located at a top, bottom, middle, or a combination thereof of the spine, binder mechanism, or both.

The holders may function to connect to and hold materials in the binder. The holders may be circular, oval, have a flat side, two opposing halves, or a combination thereof. The holders may be openable and closeable to receive papers. Preferably, the holders extend into holes in paper (e.g., created by a two hole punch or a three hole punch). The holder may include two halves that connect together. The holder when in a closed position may create a continuous loop. The holder when in an open position may receive papers.

The binder may be formed by method steps discussed herein which may be created in virtually any order. A spine may be formed. The spine may be connected to a front cover, a rear cover, or both. The spine may be formed of one or more layers. The material of the spine may extend along a first side of the front cover, the rear cover, or both. The material of the spine may extend along a second side of the front cover, the rear cover, or both. The material of the spine may be different than any materials of the cover. A binder mechanism may be connected to the spine. A rigidification device, protector, or both may be connected to the spine. A protector may extend around one or more sides, one or more edges, or both of a rigidification device. The protector may be closed to form a sealed region. The spine may be folded, pleated, or both. The spine may expand, contract, or both. The spine may be penetrated by one or more fasteners. The spine may be cut, punched, or both. The fasteners may create a hole. The fasteners may extend through a pre-existing hole.

FIG. 1 is a perspective view of a binder 2 with covers 10. The covers 10 include a front cover 12 and a back cover 14. The front cover 12 and the back cover 14 rotatably connect with a spine 30 at connection regions 32. The connection regions 32 and expansion regions 34 allow for rotatable and expandable movement of the front cover 12 and the back cover 14. The spine 30 is connected to a binder mechanism 50 at fasteners 52 that are located along both the spine 30 and the binder mechanism 50.

Figure 2A:
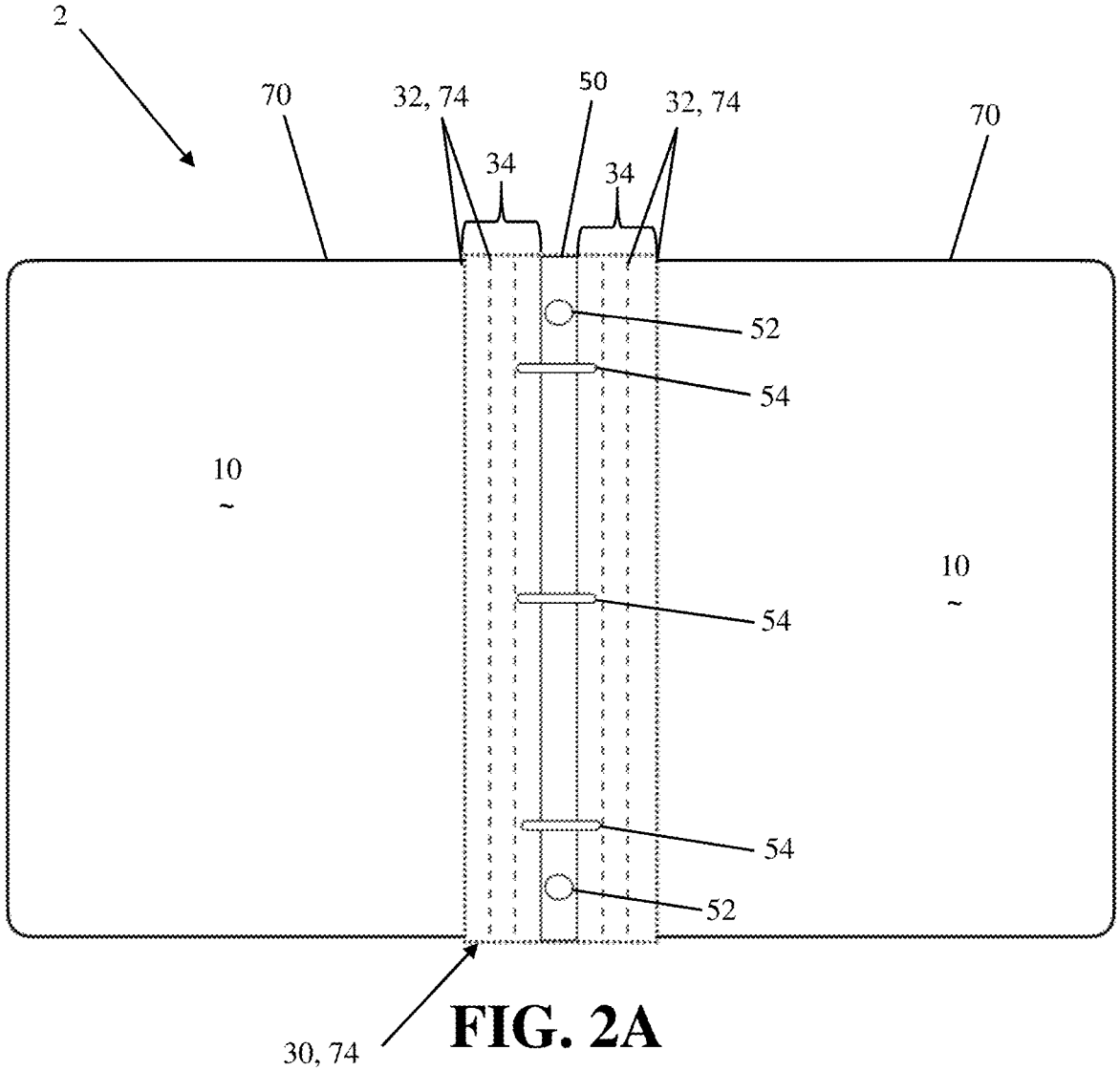
FIG. 2A is a front view of a binder that is in an open position.

FIG. 2A is a front view of a binder 2 that is in an open position. The binder 2 includes covers 10 and a spine 30 that connect at connection regions 32 and expansion regions 34. A binder mechanism 50 and the spine 30 is secured by fasteners 52. The binder mechanism 50 includes holders 54 that are positioned along the binder mechanism 50 and between the fasteners 52. The covers 10 are composed of the first material 70. The spine 30 and the connection regions 32 are composed of a third material 74.

Figure 2B:
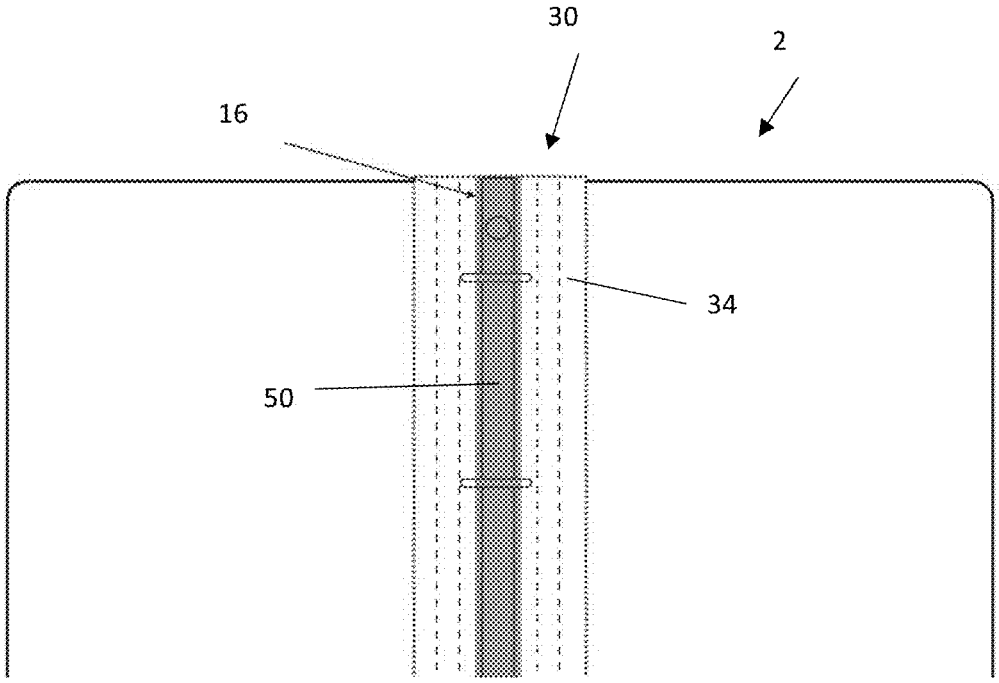
FIG. 2B is a front view of a binder in an open position with the spine including a rigidification device.

FIG. 2B is a front view of a binder 2 that is in an open position. The binder 2 includes a spine 30 with a binder mechanism 50 and a rigidification device 16 that retains a shape of a portion of the spine 30 while the expansion regions 34 are a flexible portion of the spine 30.

Figure 3:
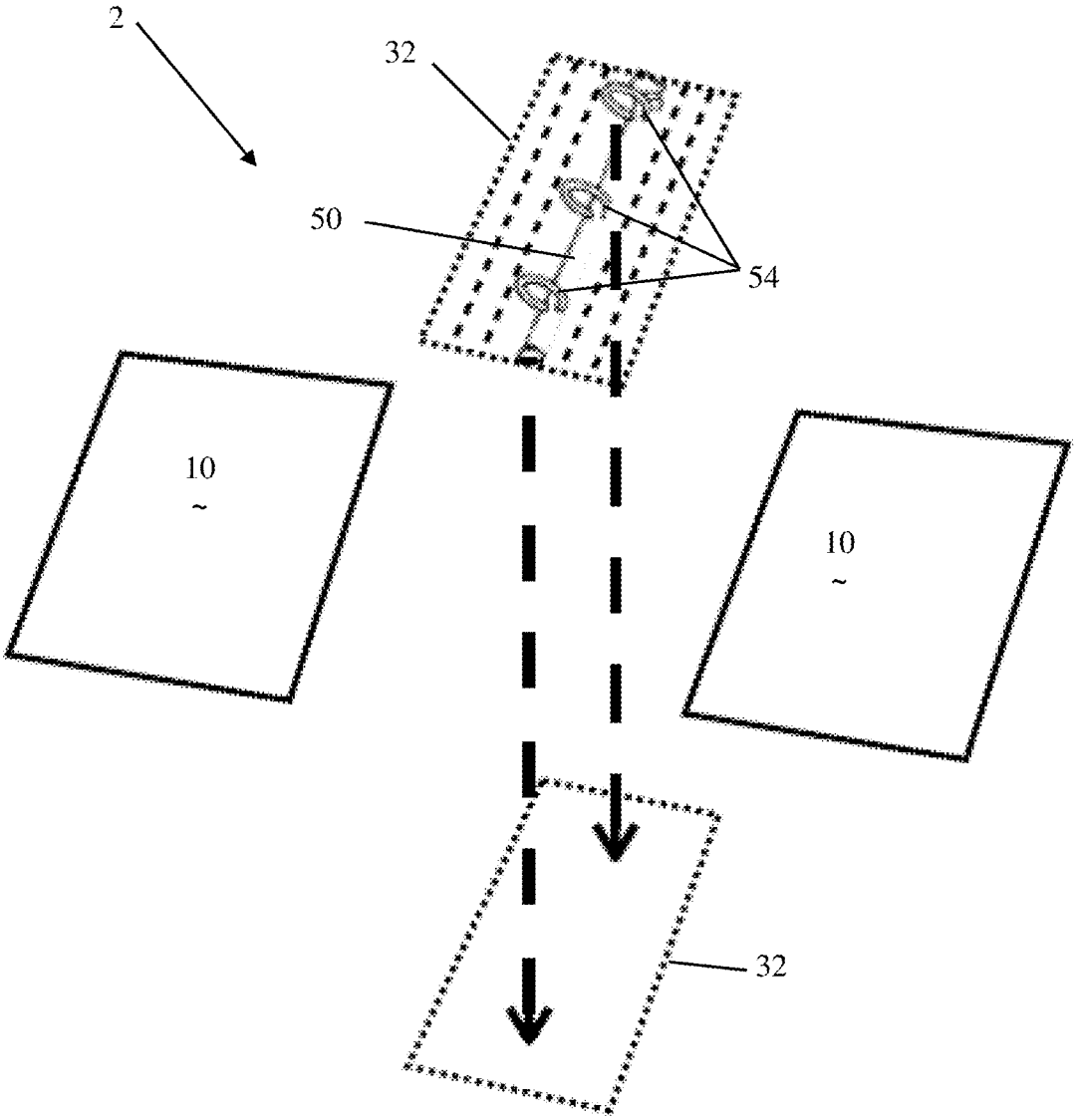
FIG. 3 is an exploded view of a binder.

FIG. 3 is an exploded view of a binder 2 including covers 10, connection regions 32, and a binder mechanism 50. The binder mechanism 50 includes holders 54. The connection regions 32 are positioned above and below the covers 10, and the covers 10 are sandwiched together at a connecting position to form the binder 2.

Figure 4:
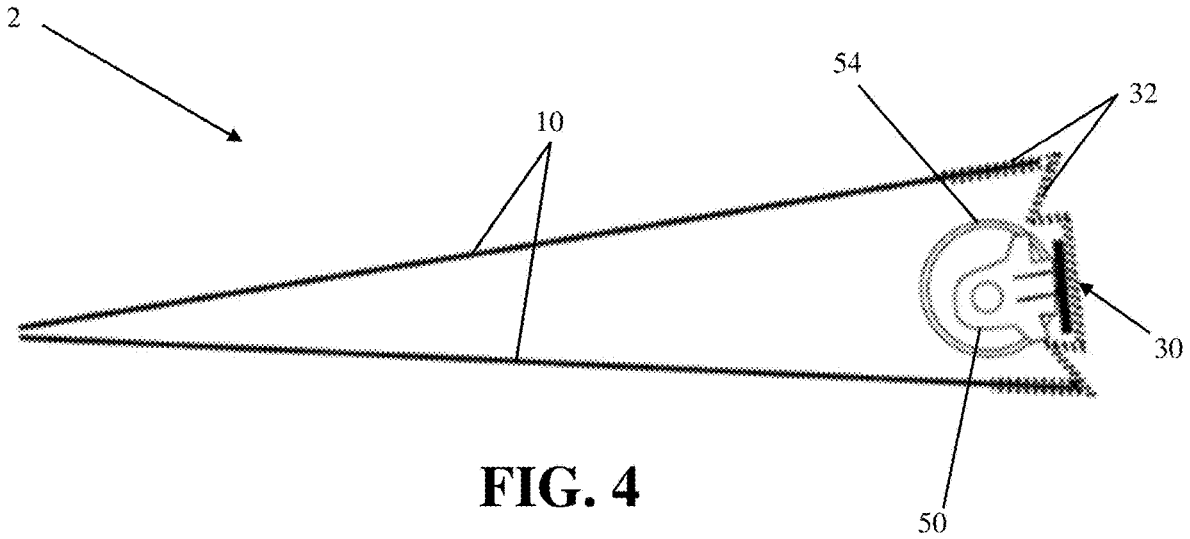
FIG. 4 is a top view of a binder.

FIG. 4 is a top view of a binder 2 including covers 10 and a spine 30 that are rotatably connected at connection regions 32. The covers 10 are free of contact relative to the opposite cover 10 at edges that are laterally opposite of the spine 30. The spine 30 and a binder mechanism 50 are connected. The binder mechanism 50 includes a holder 54.

Figure 5:
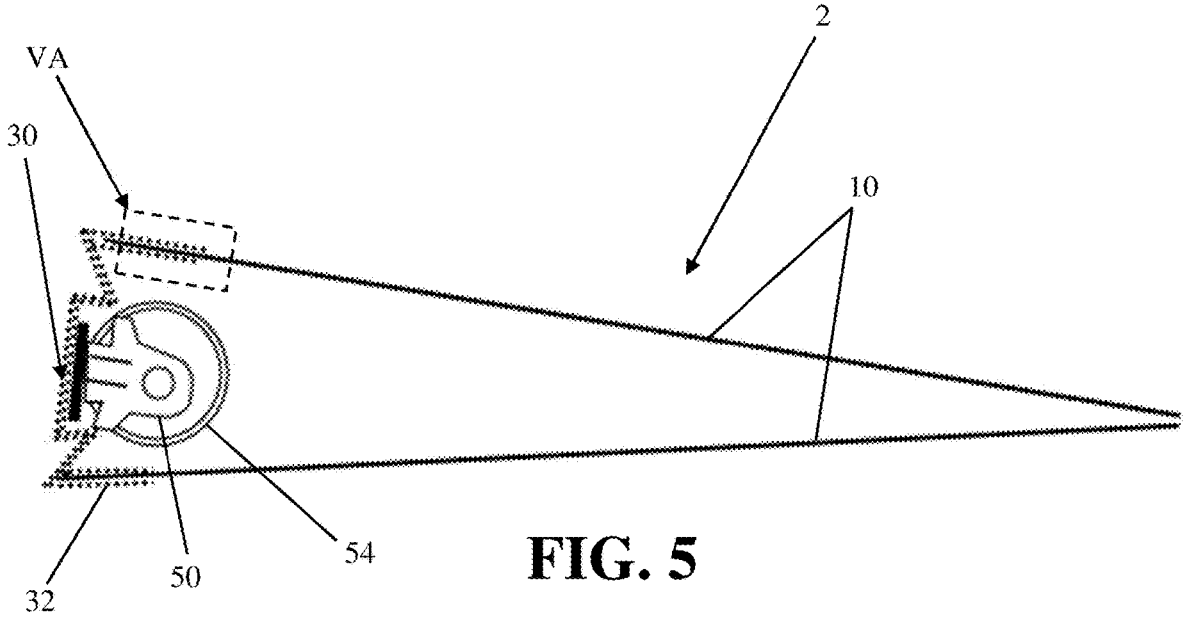
FIG. 5 is a bottom view of a binder.

FIG. 5 is a bottom view of a binder 2 including covers 10 and a spine 30 that are rotatably connected at connection regions 32. The covers 10 are free of contact relative to the opposite cover 10 at edges that are laterally opposite of the spine 30. The spine 30 and a binder mechanism 50 are connected. The binder mechanism 50 includes a holder 54.

Figure 6:
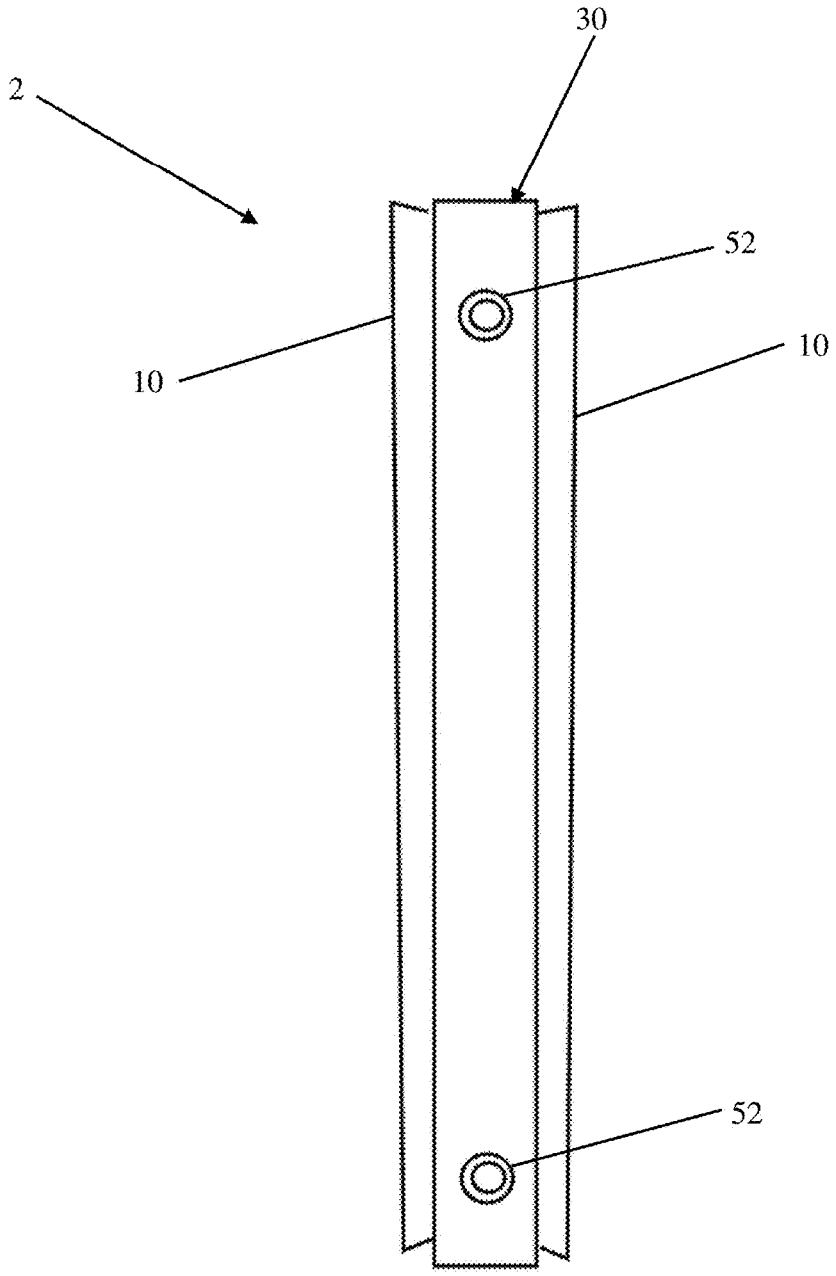
FIG. 6 is a back view of a binder.

FIG. 6 is a back view of a binder 2 including covers 10 and a spine 30 that are connected. The spine 30 and a binder mechanism (not shown) connect at fasteners 52.

Figure 7:
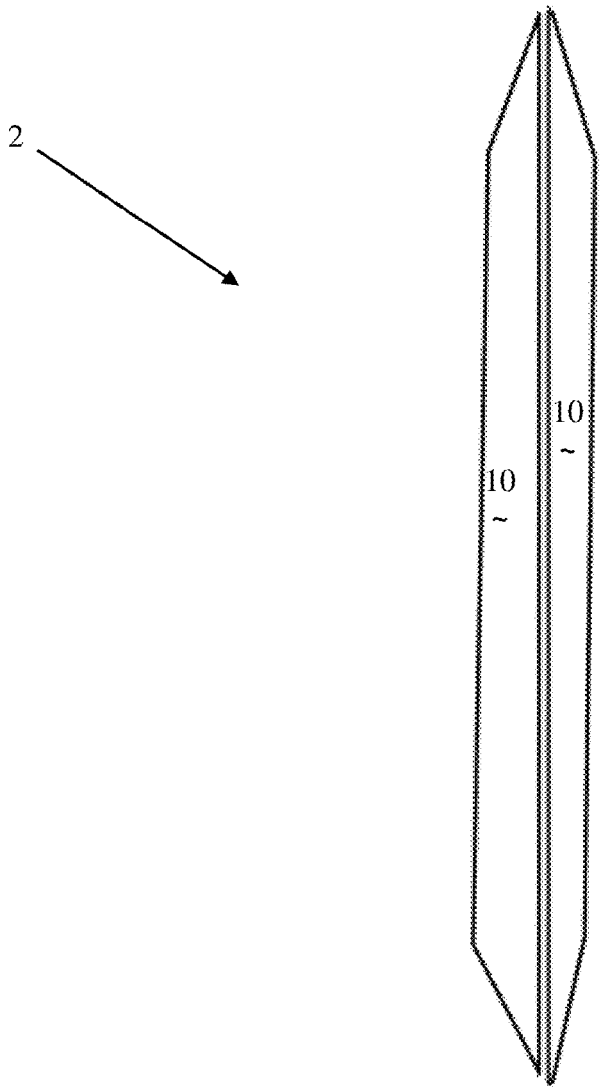
FIG. 7 is a front view of a binder.

FIG. 7 is a front view of a binder 2 including covers 10 that are free of contact relative to the opposite cover 10 at edges that are laterally opposite of a spine (not shown).

Figure 8:
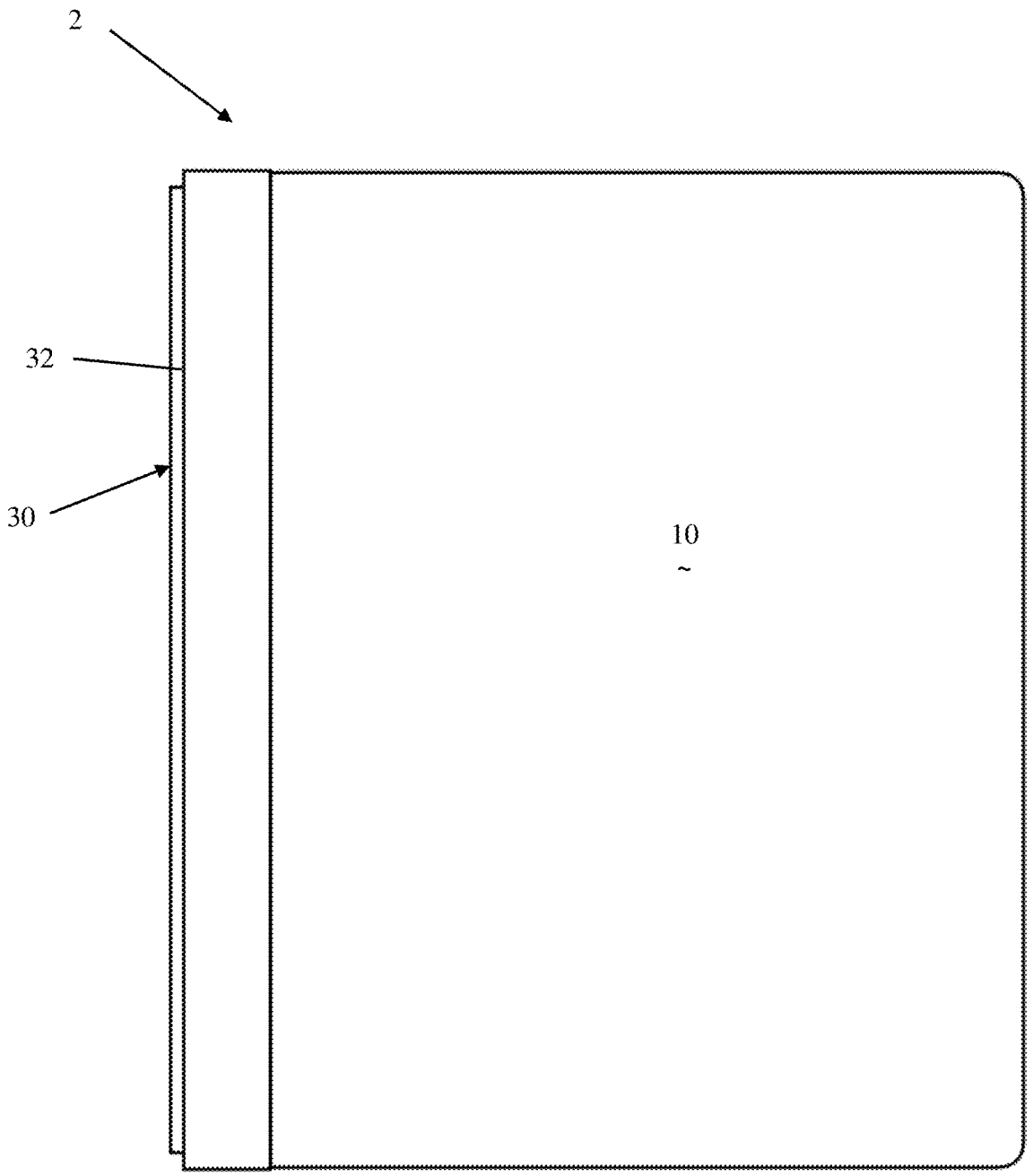
FIG. 8 is a side view of a binder.

FIG. 8 is a side view of a binder 2 including a cover 10 and a spine 30 that connect at the connection region 32.

Figure 9:
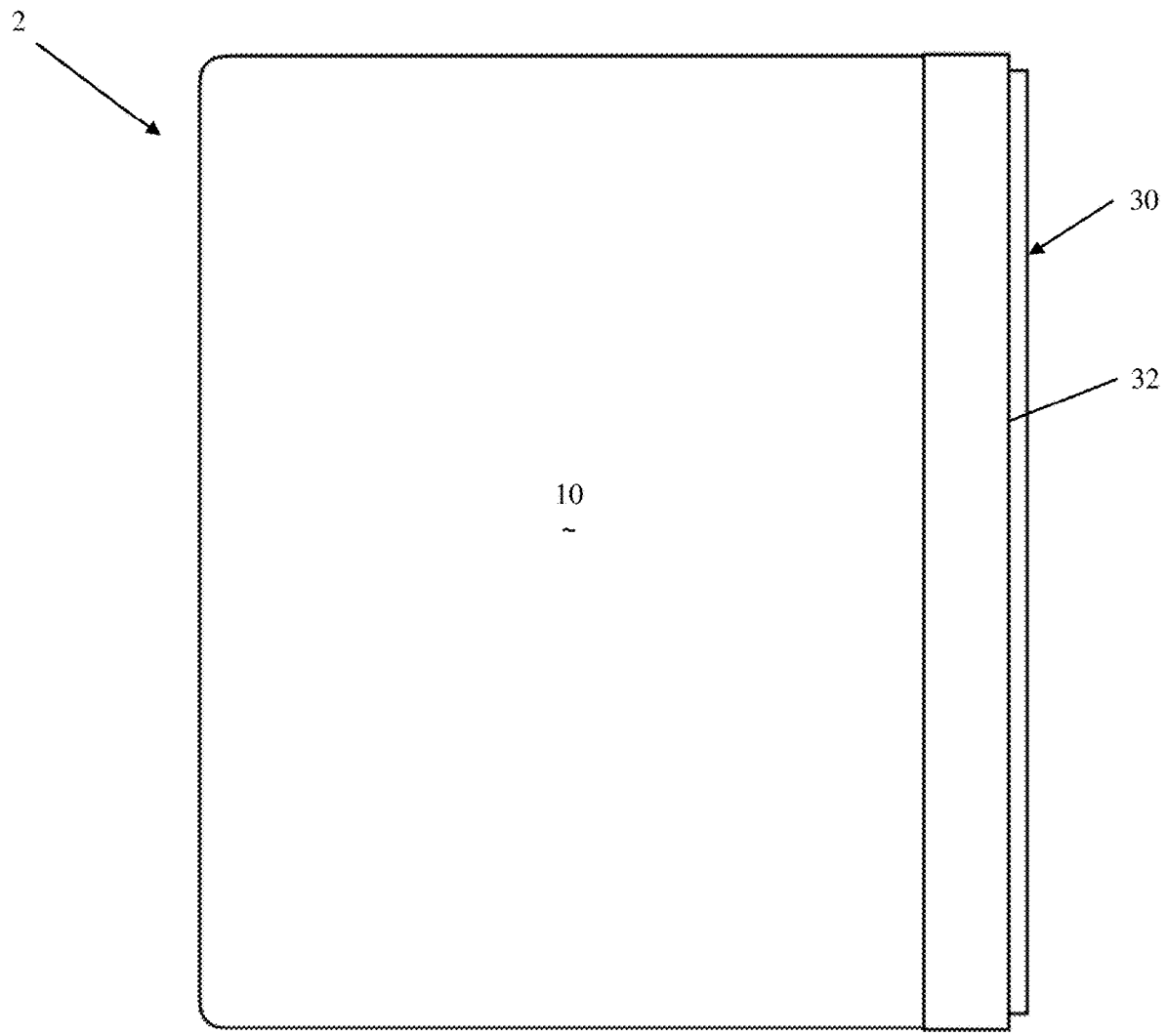
FIG. 9 is a side view of a binder.

FIG. 9 is a side view of a binder 2 including a cover 10 and a spine 30 that connect at the connection region 32.

Figure 10A:
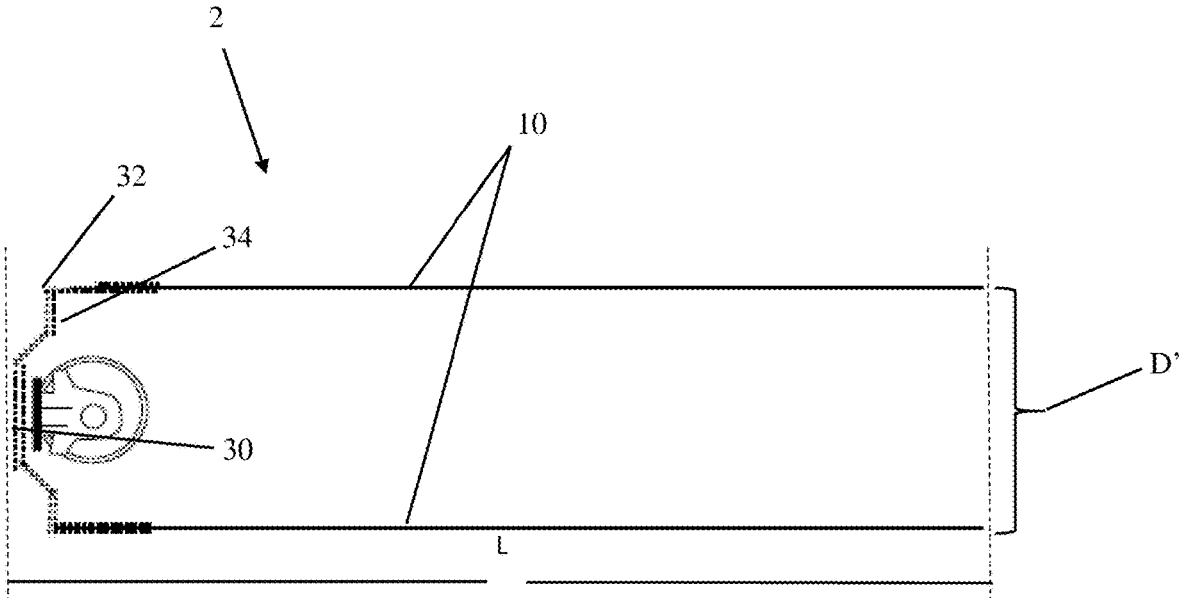
FIG. 10A is a bottom view of a binder in a filled position.

FIG. 10A is a bottom view of a binder 2 in a filled position. The binder 2 includes covers 10 and a spine 30 that connect at connection regions 32. The connection regions 32 and expansion regions 34 are in contact. The binder 2 in the filled position includes materials (e.g., books, notebooks, loose leaf paper, folders, etc.) on the interior surfaces of the covers 10 so that edges that are laterally opposite of the spine 30 are separated by width shown by distance D'. The expansion regions 34 allow expandable and contractable movement of the covers 10 in a direction substantially perpendicular of the spine 30 so that edges that are laterally opposite of the spine 30 are separated by width D'. The length of the covers 10 is shown by distance L.

Figure 10B:
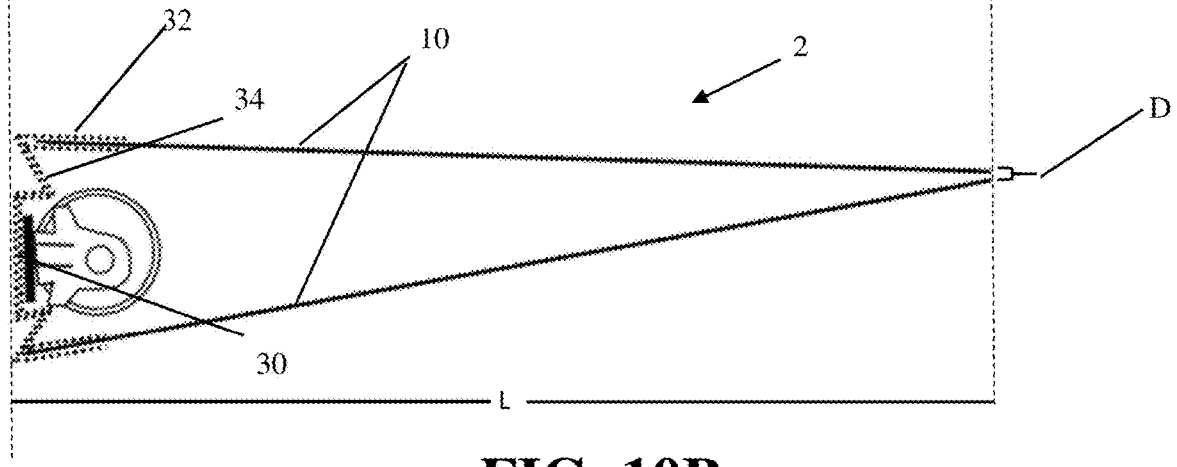
FIG. 10B is a bottom view of a binder in an empty position.

FIG. 10B is a bottom view of a binder 2 in an empty position. The binder 2 includes covers 10 and a spine 30 that connect at connection regions 32. The connection regions 32 and expansion regions 34 are in contact. The binder 2 in the empty position is free of materials (e.g., books, notebooks, loose leaf paper, folders, etc.) on the interior surfaces of the covers 10 so that edges that are laterally opposite of the spine 30 are separated by width shown by distance D, where D is less than D'. The expansion regions 34 allow expandable and contractable movement of the covers 10 in a direction substantially perpendicular of the spine 30 so that edges that are laterally opposite of the spine 30 are separated by width D'. As shown by comparison between FIGS. 10A and 10B, the binder 2 in the filled position and the binder 2 in the empty position each have a length (L) that does not vary by the addition of materials. The expansion regions 34 of the binder 2 in the filled position and the empty position allow the covers 10 to expandably and contractably move so that the width that is free of contact shown by distance D and D' can vary and the length remains a constant distance L.

Figure 11:
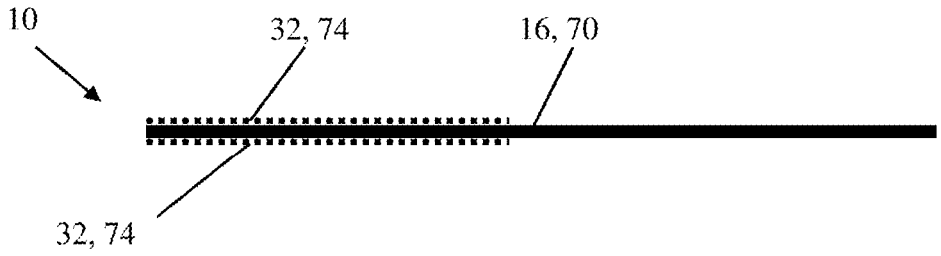
FIG. 11 is a bottom view of a cover in a box VA of FIG. 5.

FIG. 11 is a bottom view of a cover 10 in a box VA of FIG. 5. The cover 10 includes a rigidification device 16 and two connection regions 32. The rigidification device 16 and the connection regions 32 contact in a sandwich position so that an internal surface of each of the connection regions are in contact with the rigidification device 16 and an external surface of each of the connection regions 32 is free of contact with the rigidification device 16. The rigidification device 16 is a first material 70. The connection regions 32 are a third material 74.

Figure 12:
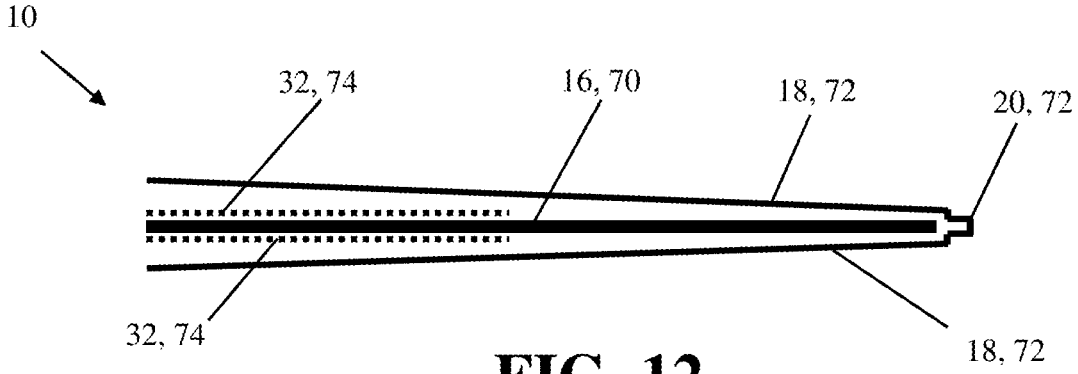
FIG. 12 is a bottom view of a cover.

FIG. 12 is a bottom view of a cover 10. The cover 10 includes a rigidification device 16, two protectors 18, a sealed region 20, and two connection regions 32. The rigidification device 16 and the connection regions 32 are in contact at the internal surfaces of the connection regions 32 to form a sandwich position between the rigidification device 16 and the connection regions 32. The protectors 18 completely surround the rigidification device 16 and the connection regions 32. The protectors 18 cover the outer surface of the rigidification device 16 and the external surface of the connection regions 32, and the protectors 18 contact at the sealed region 20 so that the protectors 18 completely enclose the rigidification device 16 and the connection regions 32. At least one outer surface of each of the protectors 18 is free of the contact with the rigidification device 16 and the connection regions 32. The rigidification device 16 is a first material 70. The protectors 18 and the sealed region 20 are a second material 72. The connection region 32 is a third material 74.

Figure 13:
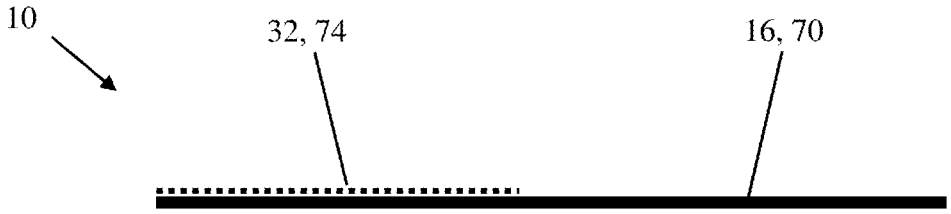
FIG. 13 is a bottom view of a cover.

FIG. 13 is a bottom view of a cover. The cover 10 includes a rigidification device 16 and a connection region 32 that are in contact. At least one surface of the rigidification device 16 is free of contact with the connection region 32, and at least one surface of the connection region 32 is free of contact with the rigidification device 16. The rigidification device 16 is a first material 70. The connection region 32 is a third material 74.

Figure 14:
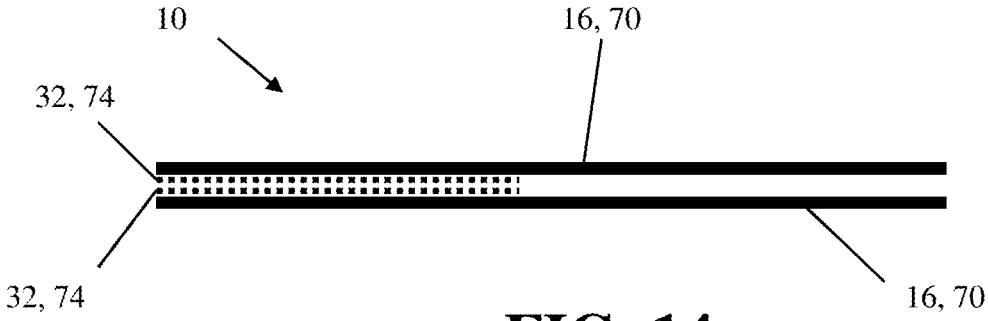
FIG. 14 is a bottom view of a cover.

FIG. 14 is a bottom view of a cover 10. The cover 10 includes two rigidification devices 16 and two connection region 32. The connection regions 32 are in contact at an internal surface of each of the connection regions 32. The rigidification devices 16 and the connection regions 32 are in contact at the external surfaces of the connection regions 32 so that outer surfaces of the rigidification devices 16 are free of contact with the connection regions 32. The rigidification devices 16 are a first material 70. The connection regions 32 are a third material 74.

Figure 15:
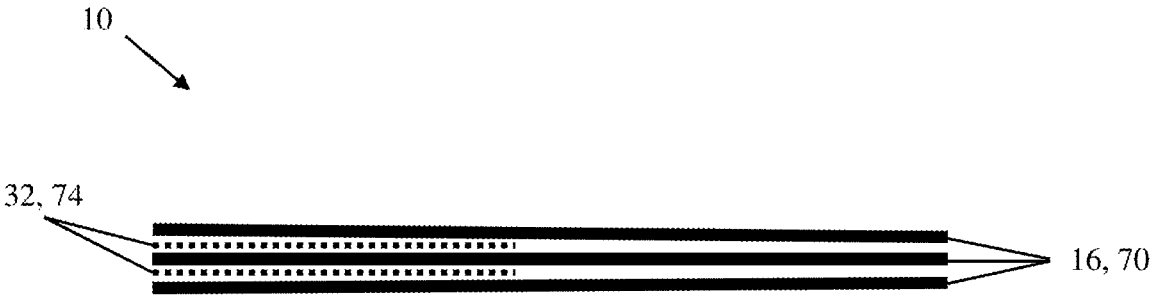
FIG. 15 is a bottom view of a cover.

FIG. 15 is a bottom view of a cover 10. The cover 10 includes three rigidification devices 16 and two connection regions 32. One of the rigidification devices 16 is internal. The rigidification device 16 that is internal and the connection regions 32 are in contact at the internal surfaces of the connection regions 32 to form a sandwich position between the rigidification device 16 that is internal and the connection regions 32. Two of the rigidification devices 16 are positioned externally relative to the sandwich position, and the rigidification devices 16 that are external contact the external surfaces of the connection regions 32. At least one surface of each of the rigidification devices 16 that are external is free of contact from both the connection regions 32 and the rigidification device 16 that is internal. The rigidification devices 16 are a first material 70. The connection regions 32 are a third material 74.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

2 Binder
10 Cover
12 Front cover
14 Rear cover
16 Rigidification device
18 Protector
20 sealed region
30 Spine
32 Connection region
34 Expansion region
50 Binder mechanism
52 Fastener
54 Holder
70 First material
72 Second material
74 Third material

I claim:

1. A binder comprising:

a) a front cover;

b) a rear cover;

c) a spine extending between and connecting the front cover and the rear cover, the spine including:

i) expansion regions that include an excess of material forming one or more pleats, wherein the spine has a width when the expansion regions are in an empty position and the one or more pleats of the expansion regions are configured to expand the width of the spine upon unfolding into a filled position so that the width of the spine in the filled position is greater than the width of the spine in the empty position; and d) a binder mechanism;

wherein the spine is a reinforced polymer that is sufficiently flexible to allow the front cover, the rear cover, or both to move relative to the spine so that the front cover, the rear cover, or both are openable and closeable, and the spine is free of hinges.

2. The binder of claim 1, wherein the reinforced material is polyethylene or a polyamide.

3. The binder of claim 1, wherein the reinforced polymer is tear resistant.

4. The binder of claim 1, wherein the binder mechanism is connected directly to the spine.

5. The binder of claim 4, wherein the binder mechanism includes fasteners that extend through and connect the binder mechanism to the spine.

6. The binder of claim 1, wherein the spine connects to the front cover and the rear cover at connection regions.

7. The binder of claim 1, wherein the front cover, the rear cover, or both are flexible.

8. The binder of claim 1, wherein the front cover, the rear cover, or both include one or more rigidification devices that are cardboard, wood, oriented strand board, plastic, a polymer, or a combination thereof.

9. The binder of claim 1, wherein the front cover, the rear cover, or both include protectors that substantially encapsulate or encapsulate the front cover, the rear cover, a connection region between the spine and the front cover, a connection region between the spine and the rear cover, or a combination thereof.

10. The binder of claim 1, wherein the expansion regions are located on a first side of the spine and a second side of the spine of the spine and the one or more pleats in each of the expansion regions are two or more pleats.

11. The binder of claim 1, wherein the expansion regions are configured to expand a width of the spine without lateral movement of ends of the front cover and the rear cover toward the spine.

12. A binder comprising:

a) a front cover;

b) a rear cover;

c) a spine extending between and connecting the front cover and the rear cover, the spine being made of a different material than the front cover and the rear cover; and d) a binder mechanism;

wherein the spine is a reinforced polymer that is sufficiently flexible to allow the front cover, the rear cover, or both to move relative to the spine so that the front cover, the rear cover, or both are openable and closeable; and wherein the reinforced polymer includes: high density polyethylene fibers that are randomly oriented and are compressed together to form a sheet of material or a polyamide having a fiber reinforced nylon formed into an adhesive tape; and wherein the binder mechanism is connected directly to the spine by fasteners that extend through and connect the binder mechanism to the spine, and wherein the spine is free of hinges.

13. The binder of claim 12, wherein the spine includes expansion regions.

14. The binder of claim 13, wherein the expansion regions are movable between an empty position and a filled position so that the binder expands and contracts to accommodate additional materials being placed inside of the binder.

15. The binder of claim 13, wherein the expansion regions expand without lateral movement of ends of the front cover and the rear cover towards the spine.

16. The binder of claim 14, wherein the spine has a width in a filled position and a width in an empty position and the width of the spine in the filled position is greater than the width of the spine in the empty position and the expansion regions expand the spine from the empty position toward the full position without lateral movement of ends of the front cover and the rear cover towards the spine.

* * * * *